United States Patent [19]

Richardson

[11] 4,374,543

[45] Feb. 22, 1983

[54] APPARATUS FOR WELL TREATING

[75] Inventor: Charles N. Richardson, New London, Tex.

[73] Assignee: Tri-State Oil Tool Industries, Inc., Bossier City, La.

[21] Appl. No.: 303,190

[22] Filed: Sep. 17, 1981

Related U.S. Application Data

[60] Division of Ser. No. 179,487, Aug. 19, 1980, Pat. No. 4,314,608, which is a continuation-in-part of Ser. No. 158,889, Jun. 12, 1980, abandoned.

[51] Int. Cl.[3] ..... E21B 33/12

[52] U.S. Cl. ..... 166/192; 166/164; 166/188; 166/242; 166/317; 166/319; 166/376

[58] Field of Search ..... 166/133, 135, 164, 188, 166/192, 242, 317, 319, 374, 376, 386, 387

[56] References Cited

U.S. PATENT DOCUMENTS

| | | | |
|---|---|---|---|
| 3,062,292 | 11/1962 | Lowrey et al. | 166/123 |
| 3,091,293 | 5/1963 | Fry | 166/123 |
| 3,095,040 | 6/1963 | Bramlett | 166/317 |
| 3,115,186 | 12/1963 | Kline | 166/135 |
| 3,166,124 | 1/1965 | Johnson | 166/332 X |
| 3,211,229 | 10/1965 | Bramlett | 166/133 |
| 3,662,834 | 5/1972 | Young | 166/319 X |
| 4,040,485 | 8/1977 | Vann et al. | 166/387 X |

*Primary Examiner*—Stephen J. Novosad
*Assistant Examiner*—George A. Suchfield
*Attorney, Agent, or Firm*—Vinson & Elkins

[57] ABSTRACT

A method and apparatus are disclosed for sequentially treating two vertically separated zones in a well bore, utilizing a packer having a fluid passageway therethrough set between the zones, a pressure shearable plug at the lower end of the packer, and a retrievable fluid plug at the upper end of the packer. Once the packer, with the shear plug on its lower end, is set in the well bore between the two zones, the retrievable plug is placed in the upper end of the packer to isolate the shear plug from well pressure in the upper zone, and the desired treating steps are performed on the upper zone. The retrievable fluid plug is then removed and tubing run to the packer to establish communication with the shearable fluid plug. The shearable plug permits static pressure testing of the tubing string and seals before communication is established with the lower zone, and then may be removed by elevating fluid pressure to sufficiently shear the plug. The desired treating operations may then be performed on the lower zone. This abstract is neither intended to define the invention of the application, which of course is measured by the claims, nor is it intended to be limiting as to the scope of the invention in any way.

3 Claims, 9 Drawing Figures

10
12
24
20
16
14
18
26
32
30
28
33
35
34
22

64
12
68
39
36
38

64
42
68
44

72
68
14
28

64
90
92
94
30

APPARATUS FOR WELL TREATING

This application is a division of co-pending application Ser. No. 179,487 filed Aug. 19, 1980, now U.S. Pat. No. 4,314,608, which is a continuation-in-part of application Ser. No. 158,889 filed June 12, 1980, now abandoned.

This invention relates to the field of well treating methods and apparatus, and more particularly to a method and apparatus for sequentially treating vertically separated zones in a well bore.

An object of the invention is to provide an improved method and apparatus whereby two vertically separated zones in a well bore may be isolated by means of a non-pressure sensitive apparatus, so that high pressure treating operations may be carried out in the upper zone without establishing fluid communication with the lower zone, but wherein fluid communication may later be established with the lower zone to permit well operations to be carried out on the lower zone.

A further object is to provide such method and apparatus which also includes a pressure sensitive apparatus blocking flow between the two well zones, whereby the fluid integrity of the tubing string may be tested at a desired test pressure after performing the well treating operations on the upper zone and prior to establishing fluid communication with the lower zone.

These and other objects and advantages of the invention will become apparent from the drawings, the specification, and the claims. In the accompanying drawings, which illustrate the preferred embodiment of the invention, and wherein like numerals indicate like parts:

Figure 6A:
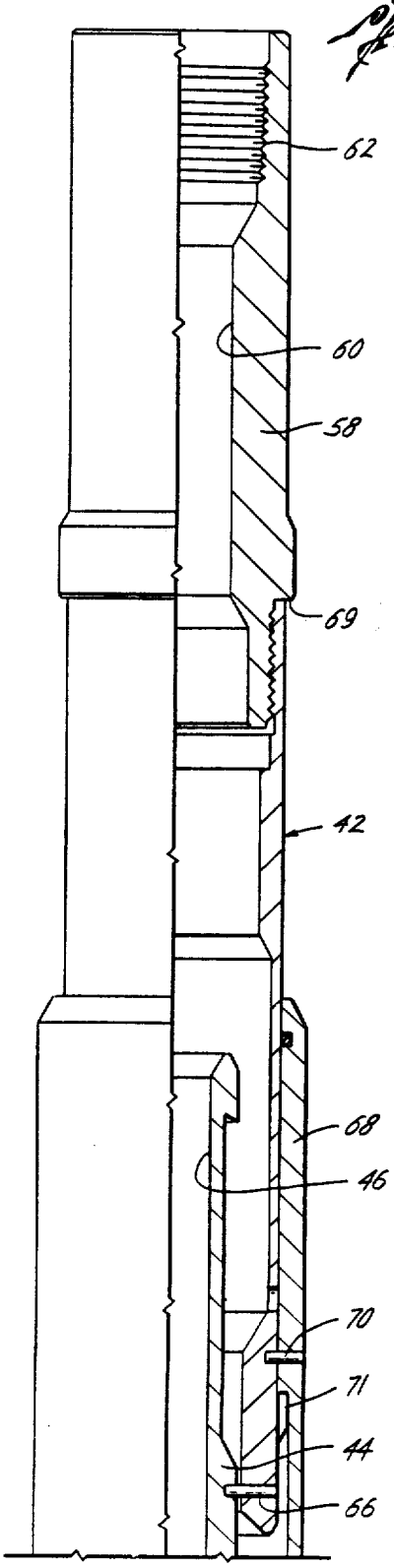
Figure 6B:
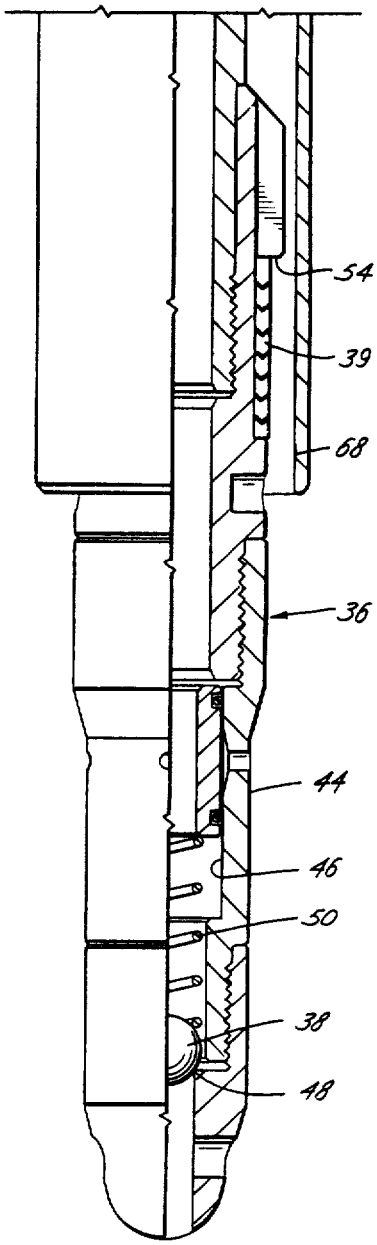
Figure 7A:
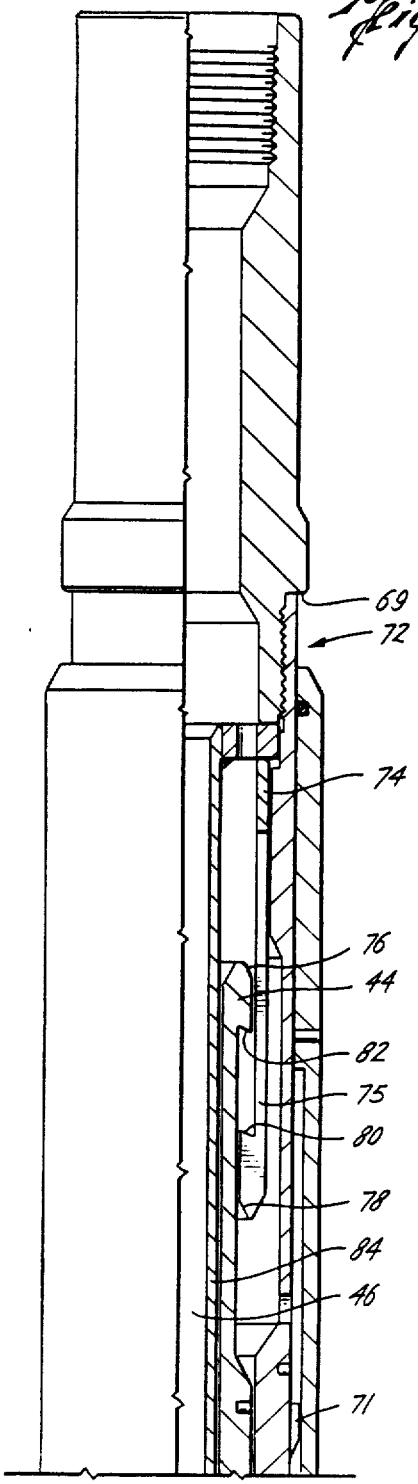
Figure 7B:
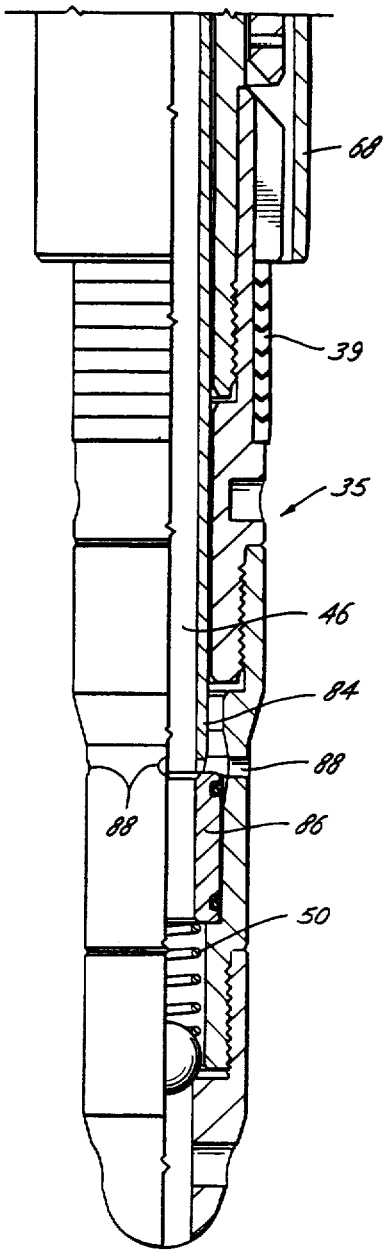

FIG. 6 (comprising the fractional FIGS. 6A and 6B) illustrates, partly in section and partly in elevation, the retrievable plug and the associated apparatus utilized for placing and setting it into the upper end of the packer; and, FIG. 7 (comprising fractional FIGS. 7A and 7B) illustrates, partly in section and partly in elevation, the retrievable plug engaged by the apparatus utilized for equalizing pressure across the plug and for removing it from the packer bore.

Figures 1, 2, 3, 4, 5:
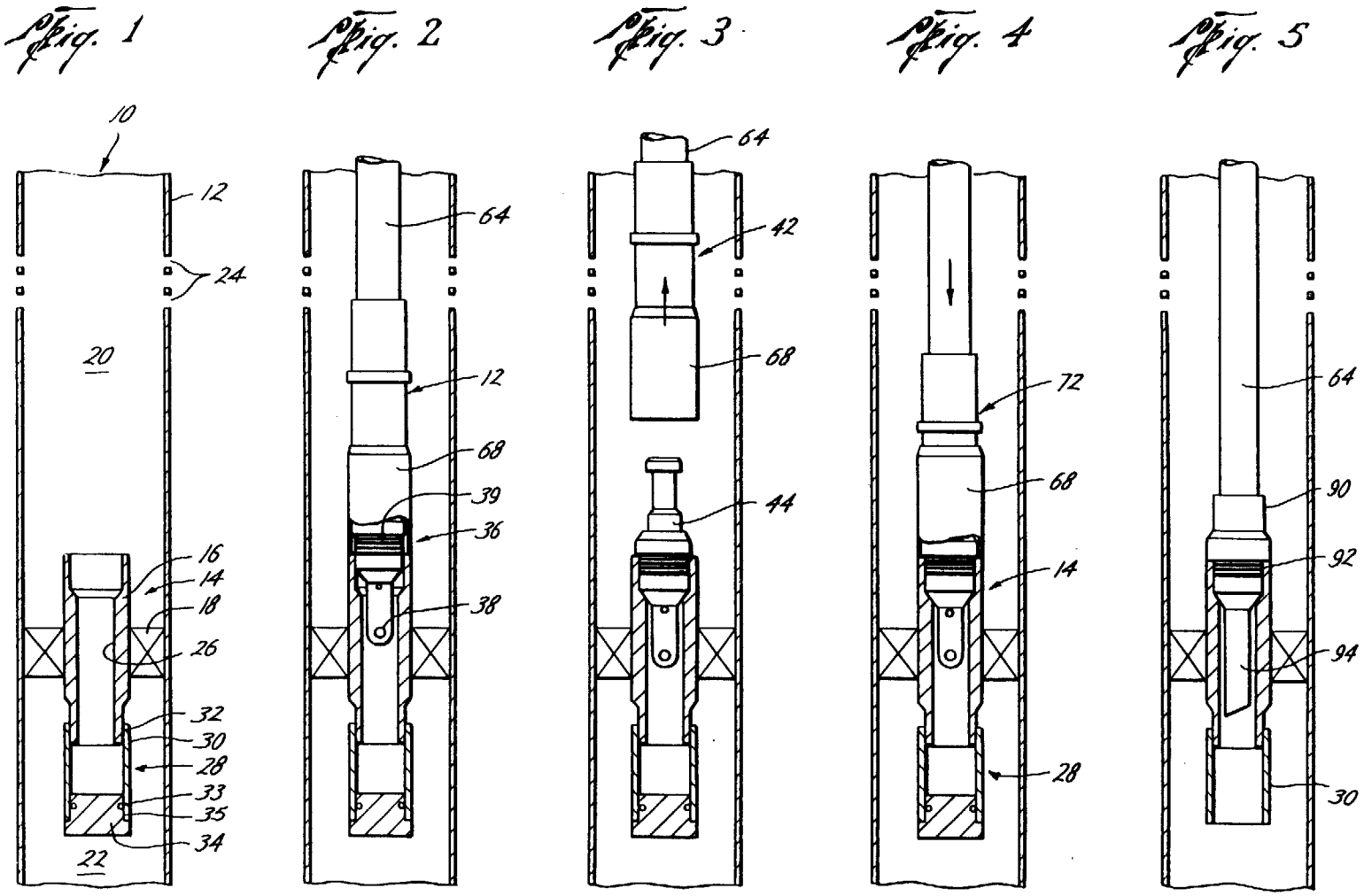
FIG. 1 is a somewhat diagrammatic illustration showing the primary packer with a pressure shearable plug at its lower end set between two vertically spaced zones in a well bore.
FIG. 2 is a view similar to FIG. 1, showing additionally a retrievable fluid plug set in the upper end of the packer by means of a tubing string and removable seating mechanism.
FIG. 3 is a view similar to FIG. 2, but with the tubing string and seating mechanism being removed, leaving the retrievable fluid plug in the upper end of the packer to isolate the packer and pressure shearable plug from high treating pressures in the upper zone of the well bore.
FIG. 4 is a view similar to FIG. 3 illustrating additionally a pressure equalizing and retrieving mechanism having been lowered by tubing into engagement with the retrievable plug.
FIG. 5 is a view similar to FIG. 4, but with the retrievable plug removed from the packer and showing additionally a tubing string seated into the upper end of the packer and in fluid communication with the lower well zone, the pressure shearable plug at the lower end of the packer having been removed by means of elevated fluid pressure supplied through the tubing string.

In FIG. 1, there is illustrated a vertically extending well bore 10 enclosed by casing 12. In the well bore there has been positioned a conventional packer 14, including a body 16 and seal elements (indicated diagrammatically at 18) engaging the inside wall of the casing. A bore 26 extends vertically through the body of the packer. The packer, which may be either of the permanent or retrievable type, has been placed and set by conventional means as, for example, by tubing or wire line. Preferred embodiment type packers include Baker models F, FA, D, or DB, or Otis type WB, all of which are adapted to be placed and set by wire line.

The packer 14 divides the well bore into two vertically separated zones, including an upper zone 20 and a lower zone 22. Frequently, it is desired to perform separate and sequential well treating operations on these two zones. For example, it may be desired to acidize or fracture a well formation through the perforations 24 in the well casing, or to swab fluid out of the upper well zone 20, or to perform any of a large number of well treating operations on the upper zone. During such operations, it is often desirable that the upper zone be isolated from the lower zone, so that only the upper zone is treated, following which it may be desirable to establish communications with the lower zone, so that it may be subjected to the same, or a different, well treating operation. It is also desirable that the means used for selectively preventing and establishing fluid communication between the two zones support at least a desired minimum test pressure so that a tubing string extending through the upper zone and into the packer, to establish fluid communication with the lower zone, may be subjected to a desired static pressure to assure that the tubing and its associated seals are fluid-tight before fluid communication is actually established with the lower zone. In the method and apparatus of the present invention, this is accomplished by utilizing with the packer a pressure shearable plug which will withstand the desired test pressure, but may be sheared at a higher pressure, in combination with a retrievable plug at the upper end of the packer, above the shear plug, to insulate the pressure shearable plug from high fluid pressures which may be exerted on the upper zone during its treating operation.

Accordingly, the lower end of the bore 26 in the packer body is closed by a pressure shearable plug, indicated generally by the numeral 28. The plug 28 includes a cylindrical body portion 30 attached to the lower end of the packer body 16 by threads 32 and a closure 34 having threads 35 engaging the body 30. An o-ring seal 33 is included above threads 35 to seal between the closure 34 and the cylindrical body 30. In operation, it is intended that the threads 35 of the closure 34 will shear away when the plug 28 is subjected to a sufficient fluid pressure differential across the closure member 34. The pressure at which the closure will shear away is, of course, dependent upon the number and size of the threads 35 and the material from which the closure 34 and its threads 35 are manufactured. Although any material may be used, it is preferable to use a soft metal, such as aluminum, which may later be drilled out of the well, or a metal such as magnesium, which may be dissolved readily in acid, to permit the eventual removal of the sheared closure 34 from the well bore.

The pressure shearable plug 28 is preferably attached to the packer 14 prior to the packer being run into the well. Therefore, as soon as the packer 14 is set in the casing 12, the upper and lower zones of the well are fluid-isolated from each other and it would be possible to proceed with desired treating steps on the upper zone. However, in practice, many of the treating steps, such as fracturing or acidizing, are done at greatly elevated pressures in order to force the treating chemicals far back into the well formations. Operations at such high pressures would present a danger of prematurely shearing the pressure shearable plug and establishing fluid communication with the lower well zone. Therefore, there is preferably used in connection with the method and apparatus of the invention a second, retrievable, plug member 36, which may be sealably received within the upper portion of the bore 26 of packer 14 prior to conducting high pressure operations in the upper well bore zone. The retrievable plug 36 preferably includes a check valve means, indicated diagrammatically in FIG. 2 by the ball 38, to permit fluid displaced from the bore 26 of the packer to escape upwardly through the retrievable plug 36. Seals 39 are provided on the retrievable plug to sealably engage the walls of the packer bore 26. The retrievable plug 36 also prevents fracturing sand or other debris from falling into the bore of the packer during well treating operations on the upper zone.

Referring to FIG. 6 (which because of its length is broken into fractional FIGS. 6A and 6B), there is illustrated in greater detail the construction of the retrievable plug 36 and of the seating tool, illustrated generally by the numeral 42, utilized for placing the retrievable plug 36 into the upper end of the packer bore 26. As there shown, the retrievable plug includes a generally cylindrical body 44 having a bore 46 extending vertically therethrough. The lower end of the bore is closed by a check valve formed by a ball 38 urged into engagement with valve seat 48 by coil spring 50. This check valve performs the usual function of preventing fluid flow downwardly through the bore 46, while permitting flow upwardly through the bore under sufficient differential fluid pressure to overcome the resistance of spring 50 and lift the ball 38 from its seat.

Positioned about the outside of the plug body 44 are a plurality of sealing elements 39 adapted to engage the inside surface of the bore 26 of packer 14 to establish a fluid tight seal between the retrievable plug and the packer bore. A downwardly facing shoulder 54 on the body 44 limits downward movement of the retrievable plug in the packer bore.

For placing the retrievable plug 36, there is provided a seating tool, indicated generally by the numeral 42, including a tubular body 58 having a central bore 60 therethrough and a threaded connection 62 for attachment to the tubing string 64 by means of which the seating tool and retrievable plug valve are lowered into the well bore. The seating tool 42 is releasably attached to the retrievable plug 36 as by shear pins 66. A cylindrical shround 68 depends from the lower end of the seating tool and surrounds the upper portion of the retrievable plug 36, including the seals 52, as the tool is being run into the well bore. Shroud 68 is preferably attached to the seating tool body 58 by shear pins 70. Once shear pins 70 have been sheared (as described hereinafter, vertical movement of the shroud 68 is limited by downwardly facing shoulder 69 and upwardly facing stops 71 on the retrieving tool body.

For removing the retrievable plug 36 from the packer in the well bore, there is provided a retrieving mechanism, indicated generally by the numeral 72 (FIG. 7A and 7B). As there shown, the retrieving mechanism is substantially identical to the seating mechanism 42 except for the inclusion of a split ring latch 74 having a plurality of depending latch fingers 75 adapted to be received in surrounding relationship to the upper end of the body 44 of the retrievable plug 36. Cooperating inclined surfaces 76 on the top of the retrievable plug body 44 and 78 and the lower end of the latch fingers 75 cause the individual latch fingers of the split ring latch 74 to pass by the top of the retrievable plug body 44 as the retrieving tool is lowered into position. However, opposed upwardly and downwardly facing shoulders 80 and 82 on the split ring latch fingers and retrievable valve plug body, respectively, will engage as the retrieving tool is raised so as to lift the retrievable plug from the packer.

Since the check valve in the retrievable plug prevents fluid flow downwardly through the plug into packer bore 26, lifting of the retrievable plug by the retrieving tool would pull a vacuum under the plug in the packer bore. Therefore, there is provided means for equalizing pressure across the retrievable plug prior to its removal. As shown in FIG. 7, the pressure equalizing means includes a depending stinger 84 carried by the retrieving tool and adapted to be received within the central bore 46 of the retrievable plug. As the retrieving tool is lowered into engagement with the retrievable plug, the lower end of the stinger 84 encounters the upper surface of a slide valve 86 in the bore of the retrievable plug and urges the slide valve downwardly, against the force of coil spring 50, to expose ports 88 and thereby place the bore of the retrievable plug and the bore of the packer in fluid communication. Such fluid communication will relieve any pressure differential existing across the retrievable plug and permit its easier withdrawal from the packer bore.

FIGS. 1 through 5 illustrate a sequential well treating operation performed utilizing the method and apparatus of the invention. In FIG. 1, the packer 14 and pressure shearable plug 28 have been placed, cutting off fluid communication between the upper and lower zones in the well bore. A tubing string 64, with the seating tool 42 and retrievable plug 36 attached to the lower end thereof is lowered from the surface until the lower end of the retrievable plug engages and is received within the bore 26 of the packer 14 and the bottom of shroud 68 engages the top surface of the packer body 16. Further downward force exerted by the tubing string will first shear the pins 70 attaching the shroud 68 to the body 58 of the retrieving tool. This permits the retrievable plug 36 and the remainder of the seating tool 42 to move further downwardly, to tightly engage the seals 52 on the retrievable plug with the walls of the packer bore. Once shoulder 54 on the retrievable plug 36 engages the top of packer body 16, further downward movement of the tubing string 64 will shear pins 66 and release the retrievable plug 36 from the seating tool 42. The tubing string 64 and seating tool 42 may then be withdrawn from the well (FIG. 3) prior to performing the desired well treating operation on the upper well zone 20. Alternatively, the retrievably plug may be seated in the packer by wire line operation in a conventional manner.

After the upper zone treating has been completed and it is desired to remove the retrievable plug, the retrieving tool 72 is lowered into engagement with the retrievable plug 36 (FIG. 4). As the retrieving tool is being lowered, the shroud 68 will drop to its lowest position (engaging stop 71) and therefore will be the first portion of the retrieving tool to be received around retrievable plug 36. Wash fluid supplied through the tubing 64 will thus be directed and confined by the shroud 68 to wash away sand or other debris that may have collected on or around the retrievable plug 36. Further lowering of the retrieving tool will cause the fingers 75 of latch ring 74 to pass over and around the top of retrievable plug body 44. Continued downward movement will cause stinger 84 to engage and open slide valve 86. This will equalize the pressure across the plug 36. The retrieving tool may then be raised by the tubing string, as a result of which latch 74 will engage the upper end of the retrievable plug body 44 to lift retrievable plug 36 from the packer bore and remove it from the well.

When it is desired to establish fluid communication with the zone below the packer, tubing string 64 is run into the well with a threaded sub 90 having seals 92 thereon attached to the lower end of the tubing string. The lower portion 94 of the tubing sub is received within the bore 26 of packer 14 while seals 92 engage the packer bore wall, as shown in FIG. 5. Fluid pressure within the tubing string may then be increased to a predetermined fluid test pressure, sufficient to test the integrity of the tubing string and seals 92 and, if desired, may be held at the test pressure for any predetermined period of time. With the pressure shearable plug 28 still in place, if fluid leaks are observed at the test pressure level, then the tubing string may be withdrawn from the hole and the leaks repaired without establishing fluid communication between the upper and lower well zones. However, if the tubing string and seals remain fluid tight at the test pressure, then fluid communication with the lower zone may be established by elevating the pressure within the tubing string to a sufficiently higher level to shear away the threads 35 on closure member 34 and establish fluid communication with the lower well zone.

It is, of course, desirable that the gauge pressure at the well surface (top of tubing string 64) necessary to accomplish the shearing operation be predictable with as much accuracy as possible for reliable testing and shear operations. The force required to shear closure 34 is determined by the number and size of the threads 35 and the material used. The required shear force may therefore be calculated for a given configuration and should preferably be checked with a prototype on the surface. Once the absolute shear force required is known, it may be converted into a surface gauge measurement by taking into account the bottom hole pressure (below the closure 34) and the hydrostatic pressure above closure 34, determined by the packer setting depth and the weight of the fluid used in the tubing. Obviously, it is desirable that the shear force required be greater than the maximum test pressure for the tubing 64 and seals 92, and less than the minimum pressure which would cause a rupture in the tubing or seals.

Once the closure 34 has been sheared away, the desired well treating operations may then be performed on the lower well zone through the bore of tubing string 64 and packer 14, without subjecting the upper well zone to treating chemicals or pressures used on the lower zone.

The foregoing disclosure and description of the invention is illustrative and explanatory thereof only, and various changes may be made in the size, shape and materials of construction, within the scope of the appended claims, without departing from the spirit of the invention.

What is claimed is:

1. A pressure shearable plug for use in well treating operations comprising:

a cylindrical body having a bore extending vertically therethrough;

threads formed at the upper end of said cylindrical body for attaching said body to a packer, whereby said pressure shearable plug and said packer may be used to selectively seal off a well bore;

threads at the lower end of said cylindrical body for threadably engaging a closure member; and, a closure member for closing the lower end of said bore, said closure member having threads thereon adapted to engage the threads at the lower end of said cylindrical body, said cylindrical body and said closure member being formed of different materials having different shear strengths, whereby the threads on one of said cylindrical body and said closure member will be weaker than the intermeshing threads on the other of said body and said closure member and will preferrentially shear away when said closure member is subjected to a sufficient differential pressure.

2. The apparatus according to claim 1, including additionally seal means for sealing between said cylindrical body and said closure member.

3. The apparatus according to claim 1, wherein said cylindrical body and the threads thereon are formed of steel and said closure member and the threads thereon are formed from metal selected from the group consisting of aluminum and magnesium, whereby the threads on said closure member will preferentially shear away.

* * * * *